US009303429B2

(12) United States Patent
Abraham

(10) Patent No.: US 9,303,429 B2
(45) Date of Patent: Apr. 5, 2016

(54) BURIABLE AND RETRIEVABLE ANCHORING DEVICE

(76) Inventor: Allen R. Abraham, Salt Lake City, UT (US)

( * ) Notice: Subject to any disclaimer, the term of this patent is extended or adjusted under 35 U.S.C. 154(b) by 451 days.

(21) Appl. No.: 13/324,851

(22) Filed: Dec. 13, 2011

(65) Prior Publication Data

US 2013/0146112 A1 Jun. 13, 2013

(51) Int. Cl.
*E04H 15/62* (2006.01)
*E02D 5/80* (2006.01)

(52) U.S. Cl.
CPC . *E04H 15/62* (2013.01); *E02D 5/80* (2013.01)

(58) Field of Classification Search
CPC ..... E04H 15/62; E04H 15/32; E04H 12/2215; E02D 5/74; E02D 5/80; E02D 5/803
USPC ..... 135/118, 120.4, 97, 119; 52/155–156, 52/159, 160, 165, 163; 119/786–787, 119/791–793, 799; 24/115 R, 115 G, 130, 24/300–302; 248/156, 165, 87, 529–530, 248/317, 325; 405/259.1
See application file for complete search history.

(56) References Cited

U.S. PATENT DOCUMENTS

| | | | | | |
|---|---|---|---|---|---|
| 1,426,537 | A * | 8/1922 | Bauer | 24/130 |
| 2,892,518 | A * | 6/1959 | Fiske | 52/163 |
| 3,008,557 | A * | 11/1961 | Clevett, Jr. | 52/166 |
| 3,949,527 | A * | 4/1976 | Double et al. | 52/4 |
| 4,003,169 | A * | 1/1977 | Young, II | 52/155 |
| 4,738,063 | A * | 4/1988 | Alsop | 52/163 |
| 5,175,966 | A * | 1/1993 | Remke et al. | 52/163 |
| 5,461,833 | A * | 10/1995 | Murray et al. | 52/155 |
| 5,531,418 | A * | 7/1996 | Lindgren | 248/317 |
| 6,063,106 | A * | 5/2000 | Gibson | 606/232 |
| 6,389,655 | B2 * | 5/2002 | Libecco | 24/300 |
| 7,353,766 | B1 * | 4/2008 | Wiese | 114/218 |
| 8,464,738 | B2 * | 6/2013 | Simonson et al. | 135/118 |

FOREIGN PATENT DOCUMENTS

| | | | | |
|---|---|---|---|---|
| JP | 10037536 A * | 2/1998 | | E04H 15/62 |
| JP | 2004143691 A * | 5/2004 | | E04H 15/62 |

* cited by examiner

*Primary Examiner* — Winnie Yip
(74) *Attorney, Agent, or Firm* — Todd E. Zenger; Kirton McConkie

(57) ABSTRACT

Stackable anchors for use in sand, snow and the like including dead man plates, a unitary cord providing means for anchoring devices and for retrieval of the dead man plate from its buried location. In addition, an optional feature of the dead man plate includes means for receiving the unitary cord wrapped about a plurality of dead man plates to retain the anchors in stacked, adjacent relationship for compact storage.

19 Claims, 4 Drawing Sheets

BURIABLE AND RETRIEVABLE ANCHORING DEVICE

BACKGROUND

1. Field of the Invention

The present invention is directed to new devices and a system for providing a buried anchor and for easy retrieval of the buried anchor while at the same time providing the ability to compactly secure a plurality of anchors plates for compact storage in a small space such as in a tent case, backpack or other storage device.

2. Background of the Invention and Related Art

A number of anchoring devices and systems include implements which are buried in use. A number of devices include an anchor member with a rope or line attached and which require the anchor member to be driven into a host material. Such anchor devices are shaped so that when a force is exerted upon the rope or line, the buried anchor member opposes any force exerted upon the rope or line thereby providing an anchoring force. However, many prior art devices do not disclose any devices or methods for easy retrieval of the buried anchor.

In one prior art device disclosed in U.S. Pat. No. 5,461,833 a paddle shaped member is provided. The paddle is used for digging for burial of the device. The paddle has two holes. Two ropes or rope ends are attached to the paddle member. One rope through each hole. One rope or rope end is used to provide an anchoring force. The other rope or rope end is used to retrieve the paddle from its buried locations. However, U.S. Pat. No. 5,461,833 neither discloses, teaches nor suggests utilizing a unitary rope for passing through both holes and along the underside of the paddle while the paddle is buried and which unitary rope includes means for changing the tensioning force on the unitary rope from an anchoring tension to a retrieval tension. In addition, U.S. Pat. No. 5,461,833 does not teach a manner in which to compactly store a plurality of anchors in a stackable fashion.

Unlike the prior art, the present invention comprises a unitary rope extending continuously downward through one aperture in the dead man plate, along the underside of the dead man plate and upward through another aperture in the dead man plate. The unitary rope also comprises means to permit the unitary rope to be used to exert either an anchoring force or retrieval force upon the dead man, and the rope being readily removable from the dead man to permit compact, stackable storage of a plurality of dead man plates.

The present invention also provides one or more plates having a size and shape that permit them to be stacked adjacent each other and which receive a rope, cord or line wrapped about the perimeter of the plates to secure the plates for compact storage

BRIEF DESCRIPTION OF THE DRAWINGS

In order that the manner in which the above recited and other features and advantages of the present invention are obtained, a more particular description of the invention will be rendered by reference to specific embodiments thereof, which are illustrated in the appended drawings. Understanding that the drawings depict only typical embodiments of the present invention and are not, therefore, to be considered as limiting the scope of the invention, the present invention will be described and explained with additional specificity and detail through the use of the accompanying drawings in which.

DETAILED DESCRIPTION OF THE PREFERRED EMBODIMENTS

It will be readily understood that the components of the present invention, as generally described and illustrated in the figures herein, could be arranged and designed in a wide variety of different configurations. Thus, the following more detailed description of the embodiments of the system and method of the present invention is not intended to limit the scope of the invention, as claimed, but is merely representative of the presently preferred embodiments of the invention.

The present invention is directed to a novel combination dead man plate and unitary cord for providing an anchor system which can readily be retrieved from its buried state and which can be readily disassembled for compact, secure storage.

Figure 1A:
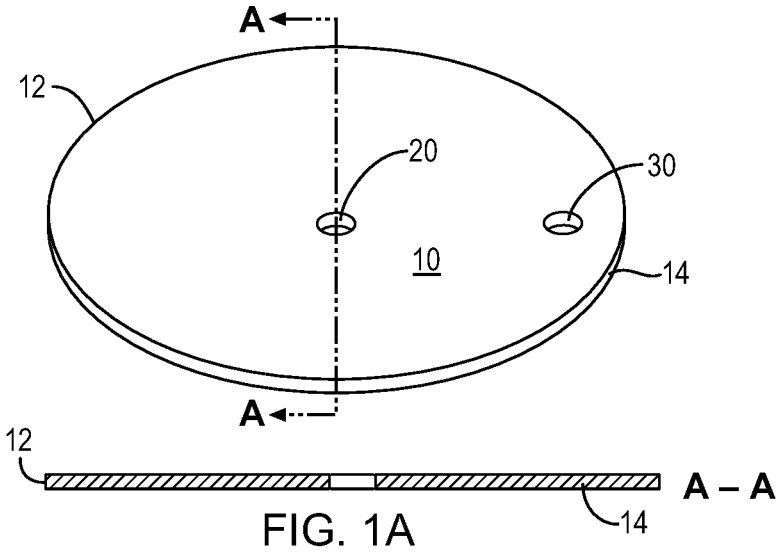
FIGS. 1A through 1C illustrate exemplary embodiments of the dead man plate of the present invention.
Figure 1B:
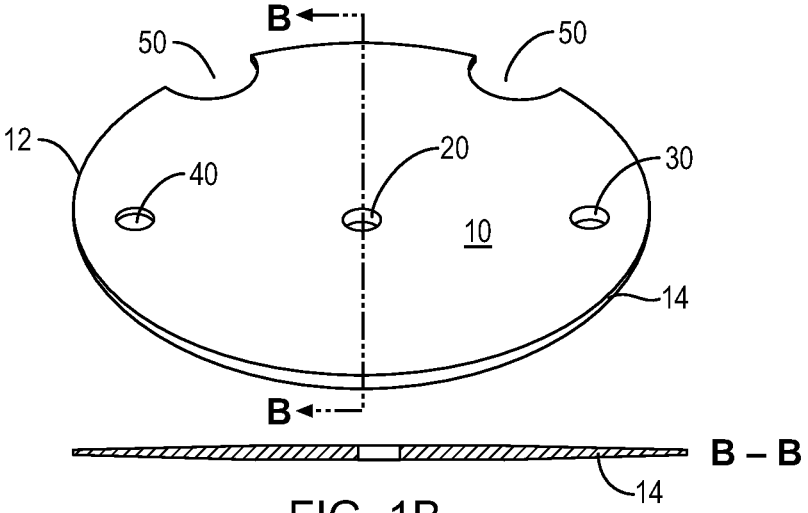
Figure 1C:
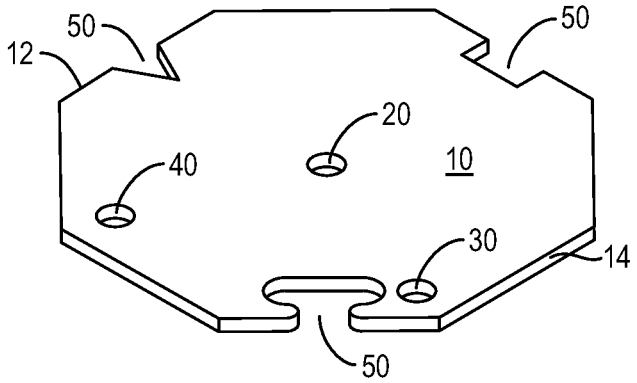

As shown in FIGS. 1A, 1B and 1C, the dead man plate 10 can comprise a number of overall geometric shapes. Whether round, oval or some other geometric shape, the structural and functional feature described herein will apply.

Plate 10 has a perimeter 12. Due to the chosen geometric shape, perimeter 12 may have a corresponding shape.

Plate 10 also comprises a cross-sectional thickness 14. Thickness 14 may be substantially uniform as shown in FIG. 1A. In the alternative, thickness 14 may taper as illustrated in FIG. 1B. Thickness 14 may vary depending on the material from which plate 10 is made. Plate 10 may be made of plastic or vinyl, metal, wood or any other sufficiently rigid material which one of skill in the art would recognize as suitable for the apertures and tensions described below.

Plate 10 comprises at least two apertures, first aperture 20 and a second aperture 30. Plate 10 may comprise additional apertures such as aperture 40. Generally, first aperture 20 is disposed at or near the geometric center of plate 10 or at or near its center of mass. This placement of first aperture 20 permits first aperture 20 to be utilized as the focal point of the anchoring forces discussed below. Second aperture 30 is placed between first aperture 20 and perimeter 12. This placement of second aperture 30 permits second aperture 30 to be utilized as a focal point of the retrieval forces discussed below. For optimal retrieval performance, second aperture 30 is placed near perimeter 12.

Figure 4:
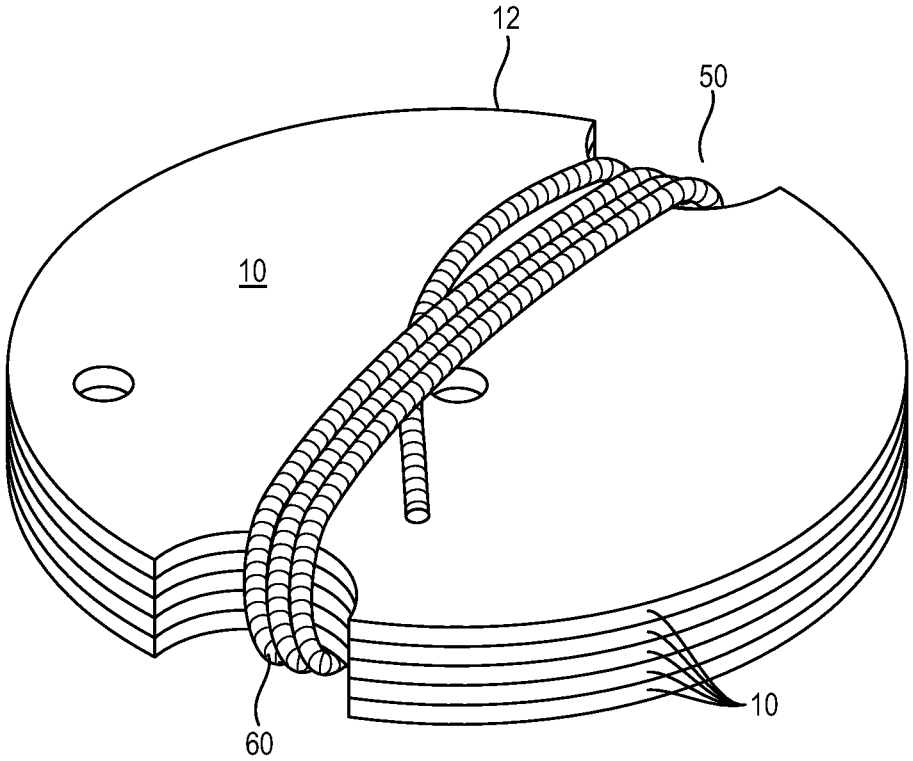
FIG. 4 depicts one embodiment of the device or system in its stacked or storage configuration

Plate 10 may also comprise one or more indentation or cutouts 50 along perimeter 12. Cutout 50 may comprise any number of shapes and sizes so long as they do not comprise the overall strength or ability of plate 10 to bear anchoring or retrieval forces with plate 10 breaking. Cutout 50 is disposed along perimeter 12 to receive a binding cord 60 as shown in FIG. 4 when a plurality of plates 10 are stacked for secured storage by wrapping cord 60 around plates 10.

The present invention also comprises cord 60. Cord 60 has a first or anchoring portion 62 over which anchoring forces are exerted against plate 10. Cord 60 also has a second or retrieval portion 64 over which retrieval forces are exerted against plate 10. Cord 60 serves as means for providing anchoring and retrieval forces. Cord 60 is disposed downward through first aperture 20, continues across the underside of plate 10 and is disposed upward through second aperture 30.

Figure 2A:
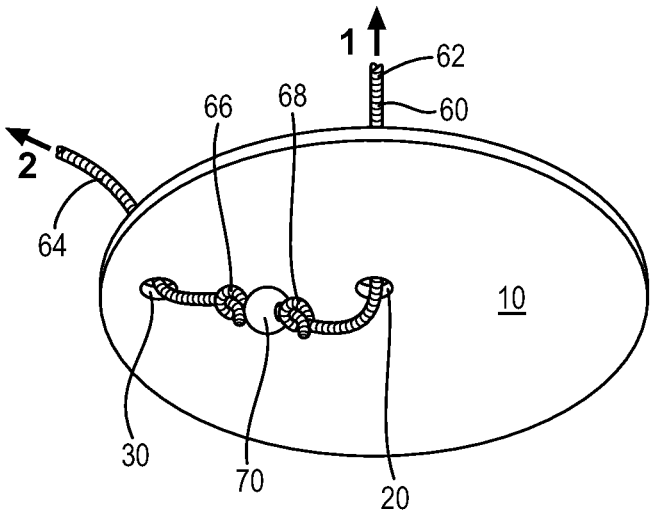
FIGS. 2A through 2C depict different embodiments of a device which provides three functions, namely a anchoring force, a retrieval force and cord to secure plates together for compact storage.

In one embodiment shown in FIG. 2A, cord 60 further comprise a knots or enlargements 66 and 68. Enlargements 66 and 68 serve to hold a tensioning member 70 such as bead or other device in place along cord 60. A knot 66 or 68 of cord 60 may suffice provided the knot is large enough to prevent member 70 from moving past the knot 66 or 68. One of skill in the art will also recognize that other devices enlargements 66 and 68 may be placed about or in cord 60, not shown, to prevent substantial movement of tensioning member 70.

Figure 3A:
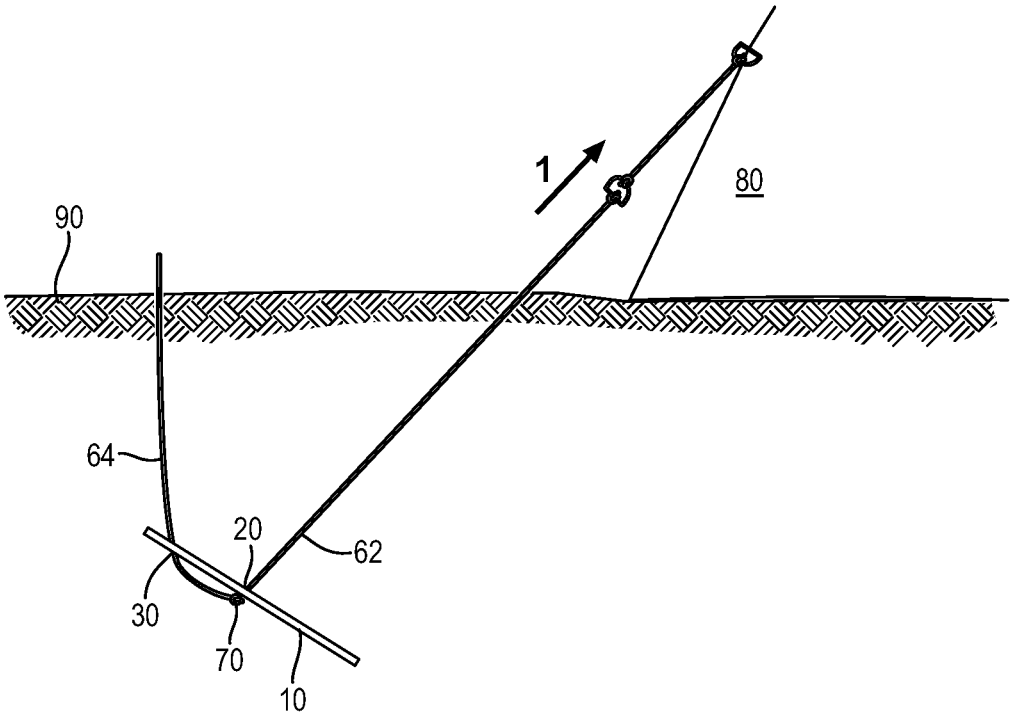
FIGS. 3A and 3B illustrate anchoring force 1 and retrieval force 2 of the present invention.

As shown in FIG. 2A, tensioning member 70 should be configured to be larger than first aperture 20 and larger than second aperture 30. In this way, when an anchoring force is exerted along cord portion 62 in the direction of arrow 1 as shown in FIG. 3A, tensioning member 70 will move to exert an anchoring force upon plate 10 at or about first aperture 20 substantially perpendicular to plate 10. This permits the user to use the end of cord portion 62 to anchor tents, awning, or any other object 80 above buried plate 10. Plate 10 may be buried in any displaceable material 90 such as soil, sand, gravel, snow, grain, seeds, fruits, vegetables, processing material such as coal, coke, mined material and the like.

Figure 3B:
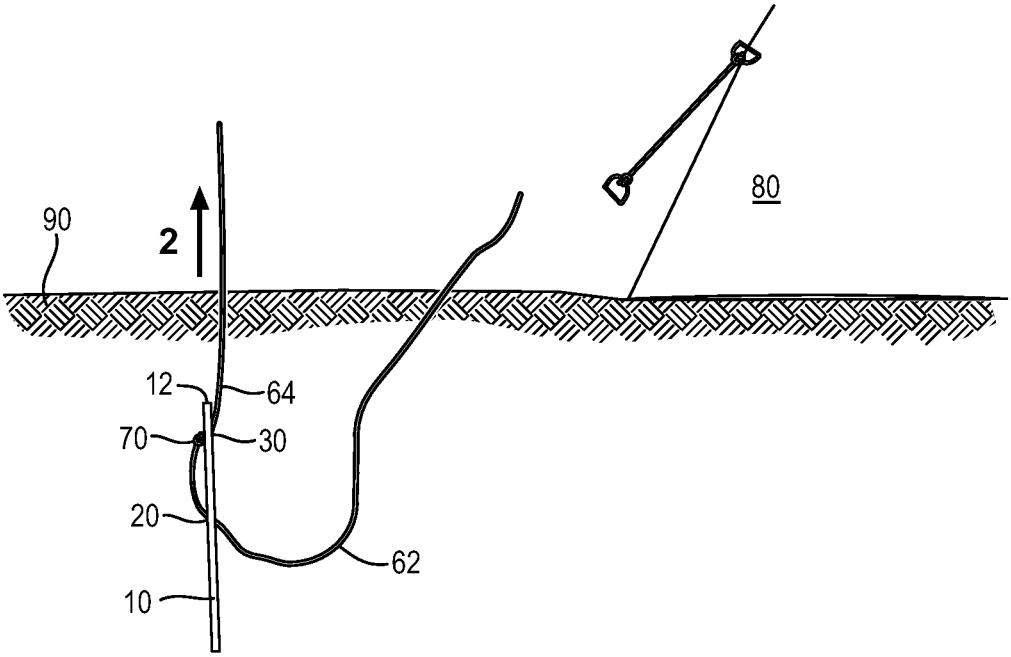

When the user desires to remove plate 10 from its buried position, the user pulls cord portion 64 thereby exerting a retrieval force on cord 60. When a retrieval force is exerted along cord portion 64 in the direction of arrow 2 as shown in FIG. 3B, tensioning member 70 will move to exert retrieval force upon plate 10 at or about second aperture 30 closer to perimeter 12. Exerting a retrieval force upon plate 10 nearer the perimeter causes plate 10 to pivot so that pulling plate 10 upward experiences less resistance because the perimeter 12 leads the way and moves through the bury material 90.

Figure 2B:
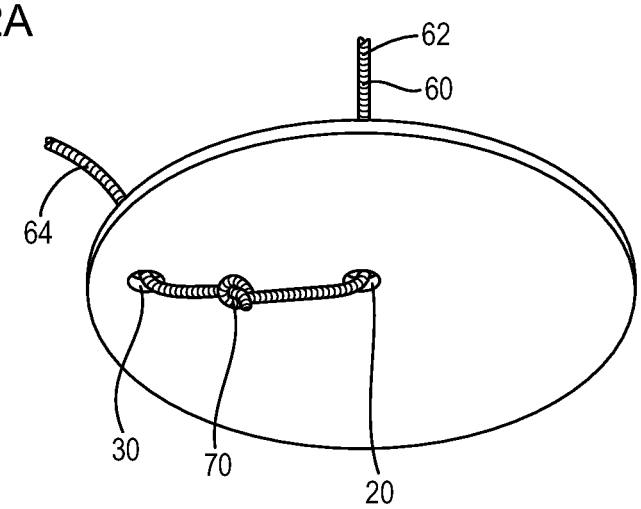
Figure 2C:
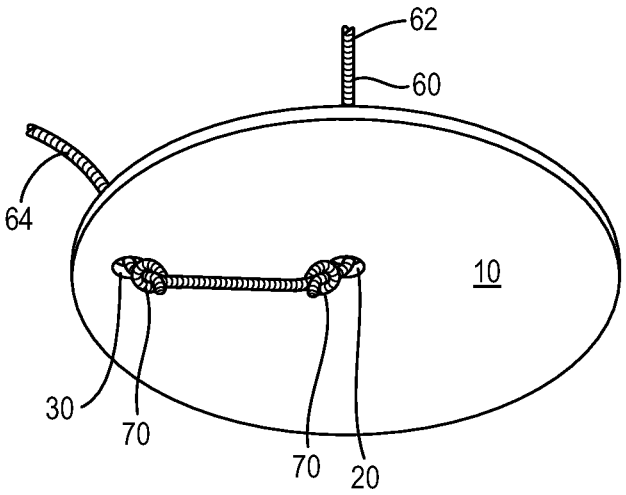

As illustrated in FIG. 2B, tensioning member 70 could comprise a knot or enlargement as described above. As shown in FIG. 2C, the present invention could comprise two tensioning members 70. So long as a knot or other enlargement along cord 60 is larger than first aperture 20 and/or second aperture 30, such a knot or enlargement can equally function as tensioning member 70. As shown in FIGS. 2A, 2B and 2C, tensioning member 70 serves as means for selectively providing an anchoring force at the first aperture 20 and also for selectively providing a retrieval force at the second aperture 30.

The illustrated embodiments of FIGS. 2A, 2B and 2C have a common structural and functional feature, namely, that cord 60 can be separated from plate 10 by simply pulling on cord 60 at or near tensioning member 70 on the underside of plate 10. In this way, plate 10 is free of cord 60 as shown in FIGS. 1A, 1B and 1C.

Cordless plates 10 can be stacked as shown in FIG. 4. Cord 60 can be wrapped around one or more plates 10. Because cord 60 serves as means for providing anchoring and retrieval forces, cutouts 50 serve as means at the perimeter of each plate for receiving the anchoring and retrieval means in bound relationship about a plurality of stacked plates 10. In this way, plates 10 can be securely stacked together for storage with the corresponding cords 60. This ensures that plates 10 and cords 60 do not become separated during storage. This also permits plates 10 to be stored in small places such in the bottom or top of tents bags, in pockets of backpacks, under seats or in small storage spaces of cars, trucks, motorcycles, boats, aircrafts or other recreational vehicles.

The embodiments set forth above are illustrative only. Many equivalents structures will be apparent to one of skill in the art. The scope of the present invention is not to be limited by the described or illustrated shapes, but is to be understood as covered by the structural and functional features described in the following numbered claims.

What is claimed:

1. A set of retrievable anchors comprising:

a plurality of substantially planar dead man plates, each plate comprising a perimeter, an upper side and an underside, a first aperture and a second aperture, the first aperture being located in the plate nearer geometric center or center of mass of the plate than the location of the second aperture, the second aperture disposed between the first aperture and the perimeter, for each plate having a first end and a second end, the cord disposed in the plate such that the cord traverses the underside of the plate with the first end of the cord passing through the first aperture and the second end of the cord passing through the second aperture;

a tensioning member disposed along the cord between the first and second apertures on the underside of the plate, the tensioning member being larger in size than the first and second apertures, such that selectively exerting a force on the first end of the cord away from the plate causes the tensioning member to press against the underside of the first aperture near the geometric center or center of mass of the plate to provide an anchoring force at the first aperture independent of the second aperture and such that selectively or alternatively exerting a force on the second end of the cord away from the plate causes the tensioning member to press against the underside of the second aperture to provide a retrieval force at the second aperture independent of the first aperture; and one or more of the cords for bounding the plurality of substantially planar dead man plates stacked together in a storage position.

2. The anchors of claim 1 wherein one or more plates comprise a substantially uniform thickness.

3. The anchors of claim 1 wherein one or more plates comprise a thickness which is greater about the first aperture and decreases toward the perimeter.

4. The anchors of claim 1 wherein the second aperture is disposed near the perimeter of the plate.

5. The anchors of claim 1 wherein the tensioning member is disposed about the cord.

6. The anchors of claim wherein the tensioning member comprises an enlarged configuration of the cord.

7. The anchors of claim 1 wherein a plurality of the plates further comprise means at the perimeter of each plate for receiving the cord in bound relationship about a plurality of stacked plates.

8. The set of retrievable anchors of claim 1, wherein the tensioning member comprises a knot in the cord.

9. The set of retrievable anchors of claim 8, further comprises a second knot in the cord.

10. A system for retrieving a buried anchor comprising:

a substantially planar dead man plate, the plate comprising a perimeter, an upper side and an underside, a first aperture and a second aperture, the first aperture being located in the plate nearer geometric center or center of mass of the plate than the location of the second aperture, the second aperture disposed between the first aperture and the perimeter, a single cord having a first end and a second end, the cord disposed in the plate such that the cord traverses the underside of the plate with the first end of the cord passing through the first aperture and the second end of the cord passing through the second aperture;

a tensioning member disposed along the cord between the first and second apertures on the underside of the plate, the tensioning member being larger in size than the first and second apertures, such that exerting a force on the second end of the cord away from the plate causes the tensioning member to press against the underside of the second aperture near the perimeter to provide a retrieval force at the second aperture independent of the first aperture.

11. The system of claim 10 wherein the second aperture is disposed near the perimeter of the plate.

12. An retrievable anchor comprising:

a substantially planar dead man plate comprising a perimeter, an upper side and an underside, a first aperture and a second aperture, the first aperture being located in the plate nearer a geometric center or center of mass of the plate than the location of the second aperture, the second aperture disposed between the first aperture and the perimeter, a single cord having a first end and a second end, the cord disposed in the plate such that the cord traverses the underside of the plate with the first end of the cord passing through the first aperture and the second end of the cord passing through the second aperture; and a tensioning member disposed along the cord between the first and second apertures on the underside of the plate, the tensioning member being larger in size than the first and second apertures, such that selectively exerting a force on the first end of the cord away from the plate causes the tensioning member to press against the underside of the first aperture near the geometric center or center of mass of the plate to provide an anchoring force at the first aperture independent of the second aperture and such that selectively or alternatively exerting a force on the second end of the cord away from the plate causes the tensioning member to press against the underside of the second aperture near the perimeter to provide a retrieval force at the second aperture independent of the first aperture.

13. The anchor of claim 12 wherein the plate comprises a substantially uniform thickness.

14. The anchor of claim 12 wherein the plate comprises a thickness which is greater about the first aperture and decreases toward the perimeter.

15. The anchor of claim 12 wherein the second aperture is disposed near the perimeter of the plate.

16. The anchor of claim 12 wherein the tensioning member is disposed about the cord.

17. The anchor of claim 12 wherein the tensioning member comprises an enlarged configuration of the cord.

18. The anchor of claim 12, wherein the tensioning member is a knot in the cord.

19. The anchor of claim 18, further comprises a second knot in the cord.

* * * * *